United States Patent [19]

Stannard et al.

[11] Patent Number: 4,690,213

[45] Date of Patent: Sep. 1, 1987

[54] PNEUMATIC PIPE WIPER SYSTEM

[75] Inventors: James P. Stannard, Houston, Tex.; Charles W. Shockley, Lafayette, La.

[73] Assignee: Pneumatic Pipewipers, Inc., Lafayette, La.

[21] Appl. No.: 825,338

[22] Filed: Feb. 3, 1986

[51] Int. Cl.[4] ..... E21B 33/08

[52] U.S. Cl. ..... 166/84; 166/82; 166/83

[58] Field of Search ..... 166/82–84, 166/93; 175/84; 251/1.3

[56] References Cited

U.S. PATENT DOCUMENTS

| | | | |
|---|---|---|---|
| 2,799,476 | 7/1957 | Bielstein | 166/93 X |
| 2,809,012 | 10/1957 | Stevens | 166/82 X |
| 3,733,641 | 5/1973 | Brown | 166/82 X |
| 3,902,215 | 9/1975 | Waldrop et al. | 166/82 X |
| 4,457,366 | 7/1984 | Brown | 166/82 |

*Primary Examiner*—Stephen J. Novosad
*Assistant Examiner*—Thomas J. Odar
*Attorney, Agent, or Firm*—Hubbard, Thurman, Turner & Tucker

[57] ABSTRACT

Disclosed is a pipe wiper device and system for stripping fluid from the external surface of tubular articles being pulled from the wellhead of a well. The wiper device includes a container having a carriage movably mounted therein. A pair of wiper pad assemblies are carried by the carriage and movable inwardly and outwardly with respect to each other. A pair of opposed actuators are provided for moving the wiper pad assemblies inward and outward with respect to each other and the connection between the wiper pad assemblies and actuators is such that the wiper pad assemblies and carriage are movable perpendicular to the direction of actuation of the actuators thereby to accommodate sideways movement of the carriage. The actuators are operated by a system that automatically retracts the wiper pad assemblies responsive to rig standpipe pressure so that the wiper pad assemblies retract automatically during drilling.

22 Claims, 5 Drawing Figures

PNEUMATIC PIPE WIPER SYSTEM

BACKGROUND OF THE INVENTION

A. Field Of The Invention

The present invention relates generally to an improved wiper device and system for removing fluid including drilling mud, oil, water or the like, from the exterior surface of tubular articles including drill strings, work strings, sucker rods, or the like.

B. Description Of The Prior Art

In rotary drilling, a typical drill string will include a drill bit, drill collars, drill pipe and kelly joint. To rotate the drill string the kelly joint is placed through a kelly drive bushing which dropped into a rotary table. The rotary table is driven by a power unit. As the rotary table is turned, the drill string is rotated to allow the drill bit to cut the earth and rock, producing a well bore. At the same time drilling fluid (commonly referred to as drilling mud) is pumped down through the drill string and bit. The drilling mud cools and lubricates the bit and then flows upward through the annulus between the well bore and the drill string depositing the bit cuttings on the surface.

During rotary drilling, it is often necessary to remove the drill string from the well, otherwise known as "tripping". As the drill string is tripped from the well, the sections of drill pipe or tubulars are typically disconnected, in stands, from the remainder of the drill string and racked near the rotary table for convenient access. When the drill string is being tripped in this fashion, various fluids such as drilling mud, oil, water or the like cling to the outer walls of the stands and, if not removed, interfere with the handling of the stands or else drop onto the rig floor making it slippery and dangerous for the workers to operate around.

In the past, it has been been the practice to remove such fluids from the outer walls of the well string at the wellhead during tripping. This has been accomplished either by spraying water onto the drill string as it reaches the surface of the rig floor, or else by passing the drill string through a flexible or elastic wiper device. The water spraying method is undesirable since the water and fluids accumulate in the working area, and because the water dilutes the fluid which is often valuable and desirable to conserve.

The wiping devices previously used usually consisted of a rubber collar which is threaded over the upper end of the well string and held stationary by the rotary bushing in the rig's floor. The tight fit of such a stationary rubber collar does not permit the passage of larger diameter tools, such as stabilizers, reamers or drill bits, thus requiring removal of the collar before the trip can be completed. Further, the well string often sways back and forth during tripping which results in uneven pressure being applied to the external surfaces of the well string, thereby preventing even and consistent wiping thereof and causing excessive wear to the stationary rubber collar.

The wiper devices presently used incorporate a plurality of separate wiper pads that are held in place against the surface of the well string during tripping or insertion thereof, which pads can be retracted to allow passage of larger diameter tools without necessitating the removal of the wiper device. Although preferable to the stationary rubber collar devices, these devices are often impeded in operation by the buildup and accumulation of drilling mud, or other fluids, therein. Some of these devices are actuated with pneumatic cylinders which have their bodies and flexible supply lines exposed to the stripped fluids and to wear and damage caused during movement of their entire assemblies within their assembly containers. Further, these devices are solely operator actuated, and do not safeguard against the damage caused thereto when an operator fails to retract the wiper pads prior to rotation of the well string during operations. Examples of wiper devices are disclosed in Brown U.S. Pat. No. 3,733,641, Stevens U.S. Pat. No. 2,809,012, Baebel U.S. Pat. No. 2,718,021, and Head U.S. Pat. No. 2,026,036.

It is therefore an object of the present invention to provide a wiper device that overcomes the shortcomings of the prior art. More particularly, it is an object of the present invention to provide an improved wiper device that can be easily installed, repaired or removed without interfering with the drilling, completion of workover operations.

It is another object of the present invention to provide a wiper device which is simple and economical to build and maintain and which does not become easily jammed by the accumulation and caking of stripped fluids therein.

It is another object of the present invention to provide a wiper device which is equipped with water jets for periodic interior wash down to eliminate caking or stripped fluids therein without making a mess on the rig floor.

It is another object of the present invention to provide a wiper apparatus having encased wiper pads which will remain in place over the well bore throughout the drilling, completion or workover of oil and gas wells.

It is another objection of the present invention to provide a wiper apparatus that the wiper pads can be actuated by means of a pneumatic valve on a control panel mounted near the driller's console.

It is another objection of the present invention to provide a wiper apparatus that when the wiper pads are in their full extended position they will close off the well bore preventing foreign objects from falling and/or dropped into the well bore.

It is another object of the present invention to provide a wiper apparatus with a carriage guide that will allow the wiper pads to remain snugly around the drill string and follow the eccentric or lateral movement of the drill string.

It is another object of the present invention to prvide a wiper device which automatically retracts the wiper pads from engagement with the well string when the well string is rotating in operation.

It is another objection of the present invention to provide a wiper apparatus which will allow the passage of larger diameter tools that may make up the drill string and still wipe them dry.

It is another objection of the present invention to provide a wiper apparatus which is virtually maintenance free and equipped with water jets for periodic interior washdown to eliminate caking of drilling mud.

It is yet another object of the present invention to provide a wiper apparatus which will trap the mud as it is wiped from the external surface of the drilling string and direct it back into the well bore.

SUMMARY OF THE INVENTION

Briefly stated, the foregoing and other objects are accomplished by the device of the present invention. The device generally includes a box-like container with openings in the top and bottom thereof for passage therethrough of the drill string. A carriage is disposed within the container and floats freely within the container in any horizontal direction. The carriage carries a pair of wiper pad assemblies with one overlying the other and oriented within the carriage so that the wiper pad assemblies may slide inward toward each other to engage the outer surface of the drill string during tripping, and slide outward with respect to each other to disengage from the drill string during rotation thereof. The sliding action of the wiper pad assemblies inward and outward with respect to each other is actuated by a pair of opposed double-acting pneumatic actuators fixedly attached to the container. The pneumatic actuators each include a cylinder and a piston rod and the piston rods are connected to the wiper pad assemblies by a cleavis and pin arrangement. The cleavis and pin are slideably attached to the carriage assemblies through elongated slots in the trailing edges of the wiper pad assemblies, thereby allowing the carriage assemblies to move freely laterally in the horizontal plane along with the sway of the well string during tripping, while the pneumatic pistons remain stationary relative to the container.

The device includes a pneumatic system for automatically moving the wiper pads out of engagement with the drill string when the drill string is being rotated. A pressure sensor valve is connected to the rig standpipe so that when the mud pumps are started prior to rotation of the string and the pressure increases in the rig standpipe, the pressure sensor valve overrides the manual control valve and directs system operating pressure to the appropriate supply port of the pneumatic pistons to retract the wiper pads from engagement with the drill string.

DESCRIPTION OF THE PREFERRED EMBODIMENT

Figure 1:
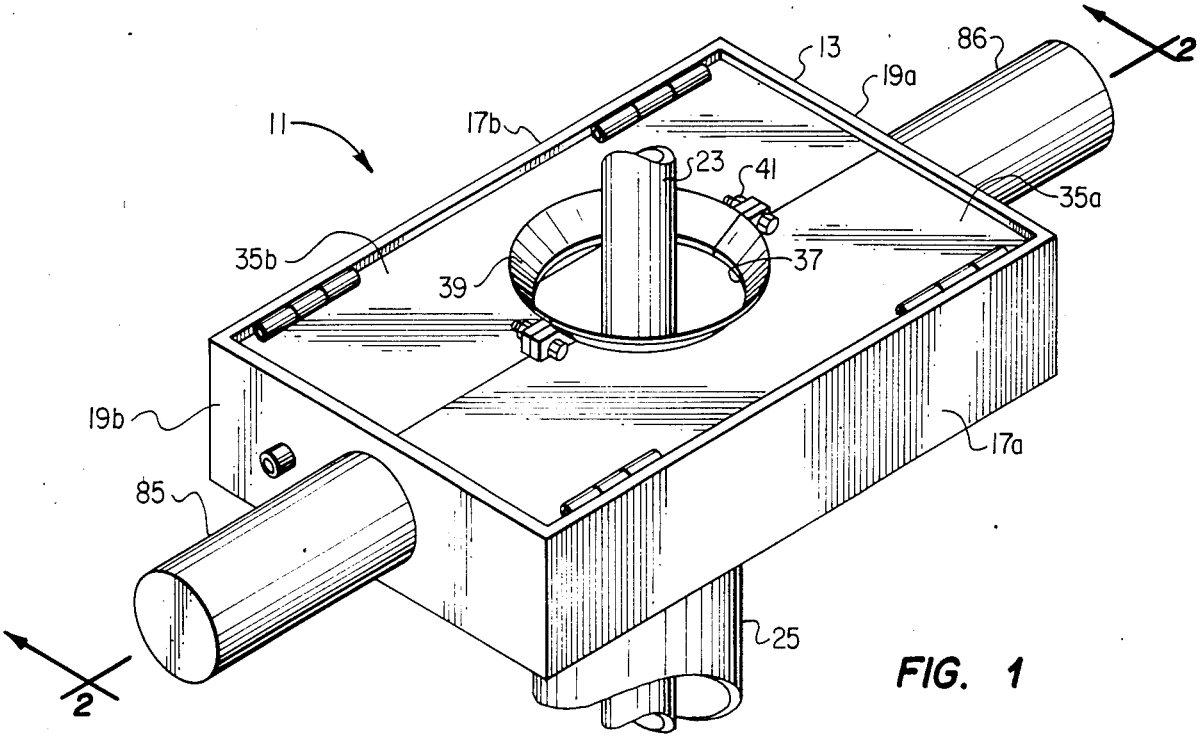
FIG. 1 is a perspective view of the preferred embodiment of the device, showing a well string therein.
Figure 2:
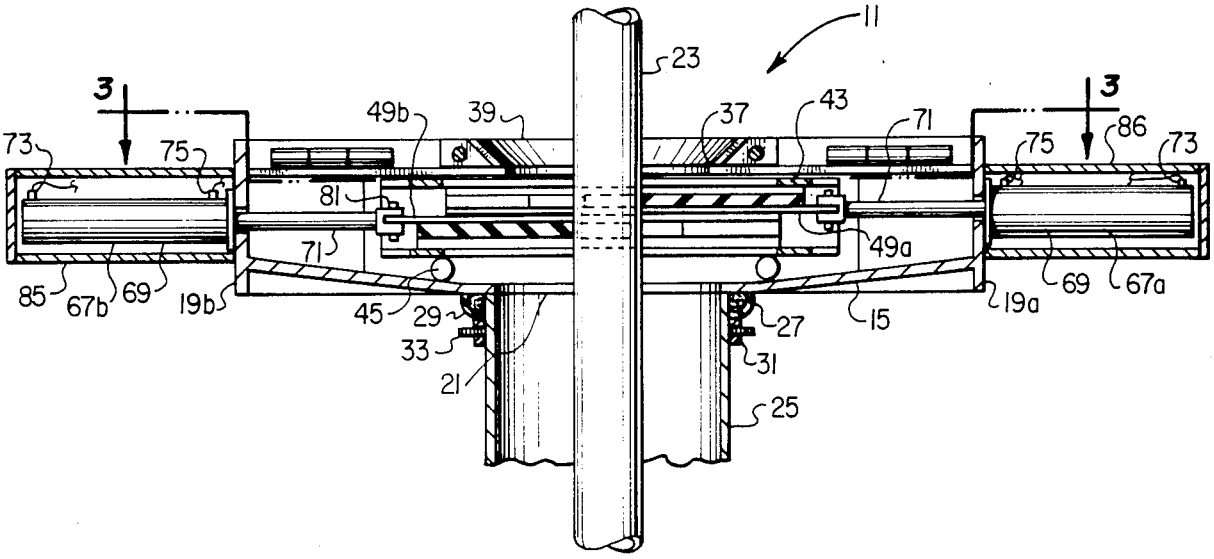
FIG. 2 is a side-sectional view taken generally along line 2—2 of FIG. 1.

Referring now to the drawings, and first to FIGS. 1 and 2, the wiper device of the present invention is designated generally by the numeral 11. Wiper device 11 includes a container 13 having a bottom wall 15, opposed side walls 17*a* and 17*b*, and opposed end walls 19*a* and 19*b*. Bottom wall 15 slopes downwardly and inwardly toward a central opening 21 so that fluid stripped from drill pipe 23 in the manner to be discussed in detail hereinafter may flow readily back into well head or bell nipple 25.

Wiper device 11 is mounted to bell nipple 25 by means of a mounting skirt 27. Mounting skirt 27 includes a SEAL-0-MATIC union 29 to establish seal between wiper device 11 and bell nipple 25 and a tubular sleeve 31. A mechanical connection between tubular sleeve 31 and bell nipple 25 is established by set screws 33, or the like.

Container 13 includes a cover which includes a pair of doors 35*a* and 35*b* hingedly connected to side walls 17*a* and 17*b*, respectively. Doors 35 and 35*b* are substantial mirror images of each other and each includes a semicircular cutout portion which together define a central opening 37 for the passage of drill pipe 23, and other articles, through wiper device 11. Central opening 37 has disposed thereabout a frusto-conical bit guide 39, which serves to guide bits into central opening 37. Bit guide 39 is split into halves with one half being connected to door 35*a* and the other half being connected to door 35*b*. Convenient latching means, as for example bolts 41 are provided for latching together doors 35*a* and 35*b* while wiper device 11 is in use. Those skilled in the art will recognize other convenient latch means.

Figure 3:
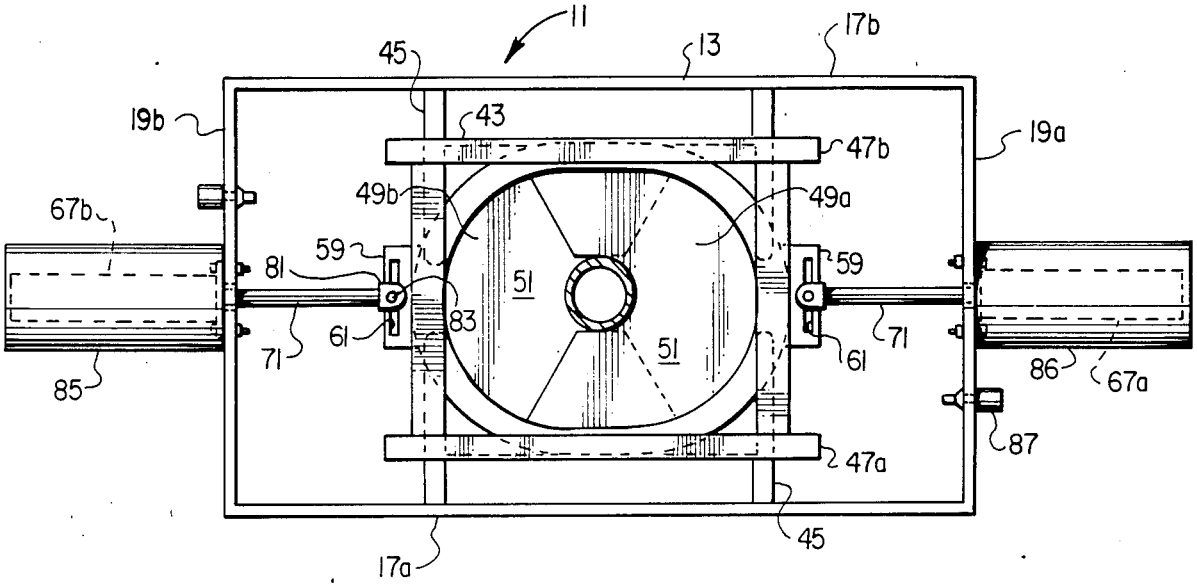
FIG. 3 is a top-sectional view taken generally along line 3—3 of FIG. 2.
Figure 5:
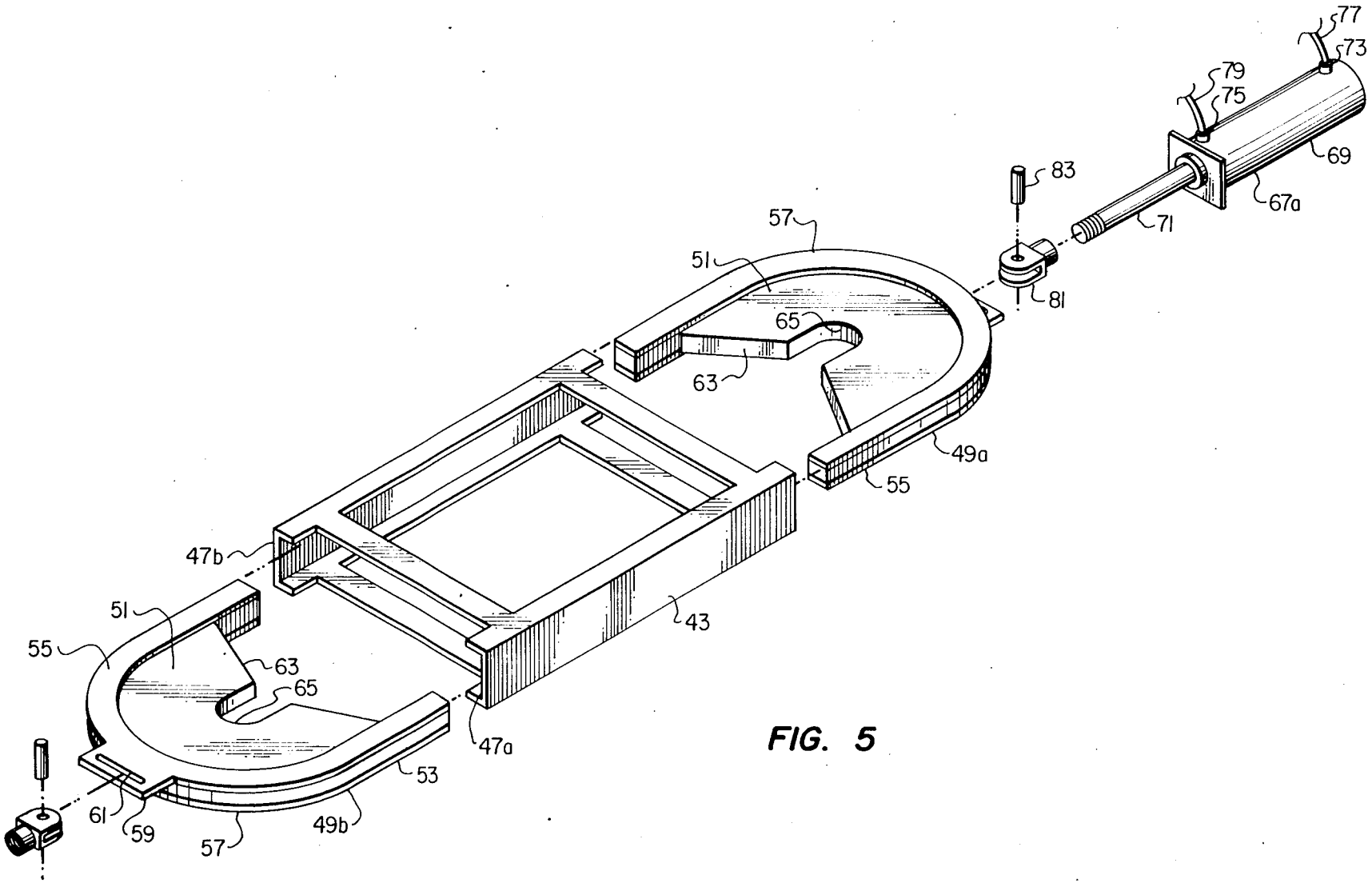
FIG. 5 is an exploded perspective view of the internal components of the device.

Referring now particularly to FIGS. 2, 3, and 5, wiper device 11 includes a carriage 43 supported within container 13 on rails 45. Rails 45 support carriage 43 horizontally above sloping bottom wall 15. Carriage 43 is freely horizontally movable on rails 45 within container 13.

Referring particularly to FIG. 5, carriage 43 includes a pair of spaced apart parallel channels 47*a* and 47*b* that are connected together by cross-braces. Carriage 43 carries a pair of wiper pad assemblies 49*a* and 49*b*. Wiper pad assemblies 49*a* and 49*b* are substantially identical to each other and each includes a resilient wiper pad 51 made of neoprene rubber or the like and a U-shaped mounting frame 53, which includes a first frame member 55 and a second frame member 57. Wiper pad 51 is sandwiched between frame members 55 and 57, which are held together by suitable fasteners (not shown). Each first frame member 55 includes at its trailing end a tab 59 having an elongated slot 61 therein.

Each wiper pad 51 has at its leading edge a truncated V-shaped guide edge 63 and a U-shaped wiper edge 65. Guide edges 63 cooperate with drill pipe 23 as wiper pad assemblies 49*a* and 49*b* are moved inwardly toward each other in the manner to be described hereinafter to assist in centering carriage 43 and moving drill pipe 23 into wiper edges 65. Wiper edges 65 cooperate to encircle drill pipe 23, as shown in FIG. 3, to strip the fluid from drill pipe 23.

Wiper pad assemblies 49*a* and 49*b* are slidingly carried in carriage 43 between channels 47*a* and 47*b* for inward and outward movement with respect to each other. Wiper pad assembly 49*b* is positioned below wiper pad assembly 49*a* and wiper pad assemblies 49*a* and 49*b* are slideable with respect to each other between an extended position and a retracted position.

Referring again to FIGS. 2, 3, and 5, wiper pad assemblies 49*a* and 49*b* are moved between the retracted and extended positions by a pair of opposed pneumatic acuators 67*a* and 67*b*. Each pneumatic actuator 67*a* and 67*b* includes a double acting cylinder 69 and a piston rod 71. Each cylinder 69 includes an extension port 73 and a retraction port 75. Extension port 73 receives air from a hose 77 and retraction port 75 receives air from a hose 79. Hoses 77 and 79 have been omitted from FIGS. 2 and 3 for the sake of clarity but those skilled in the art will readily understand how they are hooked up.

Cylinder 67*a* and 67*b* are fixedly connected to end walls 19*a* and 19*b*, respectively, by bolts or the like, as shown in phantom in FIG. 3. Piston rods 71 extend into the interior of container 13 and are connected to wiper pad assemblies 49*a* and 49*b*. Each piston rod 71 includes a cleavis 81 and pin 83 which engages slot 611 of tab 59. Retraction of piston rod 71 by the application of pressure at retraction port 75 causes wiper pad assemblies 49*a* and 49*b* to move outward with respect to each other and extension of piston rod 71 by the application of pressure at extension port 73 causes wiper pad assemblies 49*a* and 49*b* to move inward with respect to each other. Hoses 77 and 79 for both actuators 67*a* and 67*b* are connected to a common source whereby both actuators 67*a* and 67*b* act together. The pressure of fluid supplied to actuators 67*a* and 67*b* is selected low enough, as for example, 20 psig, so that movement of drill pipe 23 sideways in the direction parallel to the action of piston rods 71 causes wiper pad assemblies 49*a* and 49*b* to move with the pipe. Movement of drill pipe 23 in the direction perpendicular to the action of piston rods 71 is accommodated by the elongated slot 61 of tab 59 and its engagement with pin 83. Such perpendicular movement causes carriage 43 and wiper pad assemblies 49*a* and 49*b* to move sideways with drill pipe 23. Thus, pipe wiper device 11 accommodates movement of drill pipe 23 in all directions in the horizontal plane.

Wiper device 11 includes a pair of cylindrical guards 85 and 86 connected to end walls 19*a* and 19*b* of container 13 about cylinders 69. Guards 85 and 86 protect the cylinders and their hoses from mechanical damage during operation. Wiper device 11 may include nozzles 87 for spraying washdown water into the interior of container 13.

Figure 4:
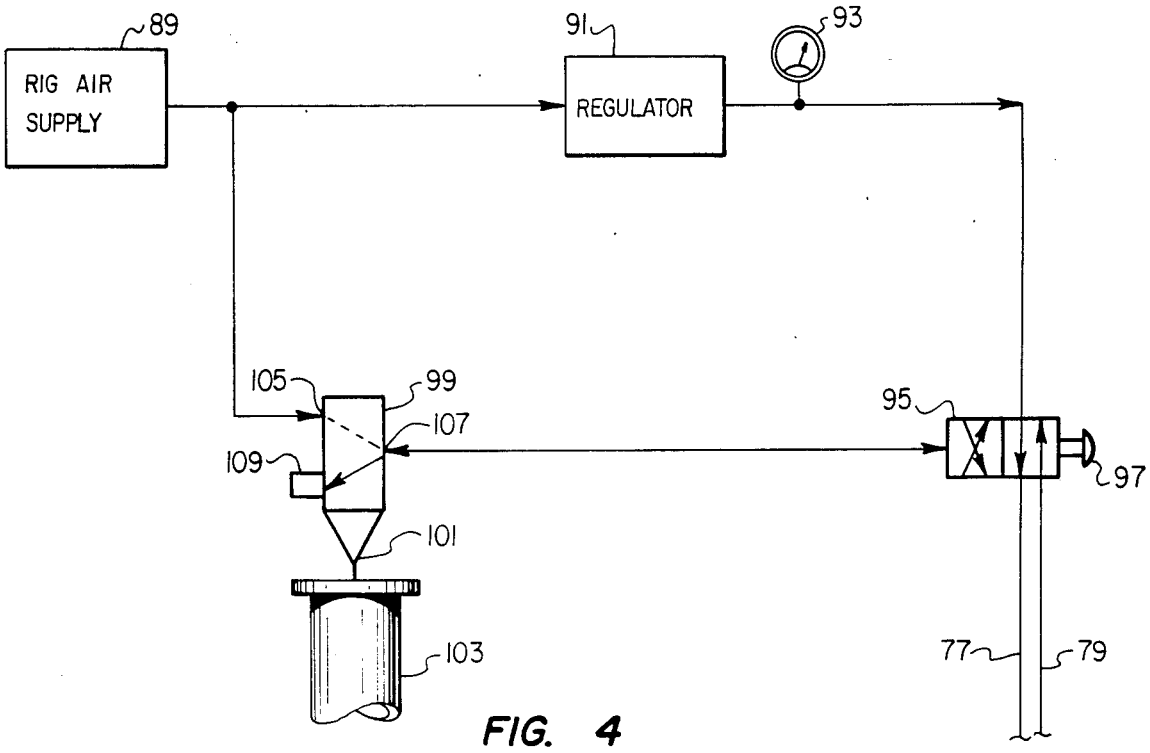
FIG. 4 is a schematic drawing of the control system for the device.

Referring now to FIG. 4, there is illustrated in schematic fashion a pneumatic system for operating wiper device 11. The operating system runs off the available rig air supply 89 and includes a regulator 91 for reducing the system pressure to about 20 psig. The operating system may include a guage 93 for monitoring the pressure of the operating system. Pressure is supplied to actuators 67*a* and 67*b* through a palm valve 95. Palm valve 95 is manually movable between and first position and a second position. In the first position, system pressure is communicated to hose 77 and hose 79 is vented, whereby actuators 67*a* and 67*b* are extended. In the second position, pressure is communicated to hose 79 and vented from hose 77, whereby actuators 67*a* and 67*b* are retracted. Palm valve 95 is conveniently mounted on a panel and includes a handle 97. Pushing on handle 97 moves palm valve to the first position; pulling on handle 97 moves palm valve to the second position.

It is contemplated that the operator would retract wiper pad assemblies 49*a* and 49*b* by pulling handle 97 during drilling. However, it is recognized that the operator may from time to time forget. The rotation of the square kelly within the extended wiper pad assemblies would tend to tear up the pads. Accordingly, means are provided so that the wiper pad assemblies retract automatically during drilling.

The automatic retraction means includes a pressure sensor control valve 99. Pressure sensor control valve 99 is a commonly available high sensor or pilot which includes a sensor inlet 101 which receives pressure from the rig standpipe 103. Pressure sensor control valve 99 also includes a control inlet 105 which receives pressure from rig air supply 889, a control outlet 107, which supplies control pressure to palm valve 95, and an exhaust outlet 109. Pressure sensor control valve 99 is thus a threeway block and bleed valve that is shiftable between a normal first position in which control inlet 105 is blocked and control outlet 107 and exhaust outlet 109 are communicated and a second position in which exhaust outlet 109 is blocked and control inlet 105 is communicated with control outlet 107. Pressure control valve 99 is spring-biased toward the first position, but is set to move to the second position when the pressure at sensor inlet 101 exceeds a preselected amount. Thus, pressure sensor control valve 99 normally supplies no pressure to palm valve 95. However, when the pressure in standpipe 103 exceeds the set point of pressure sensor control valve 99, pressure sensor control valve 99 shifts and supplies control pressure to palm valve 95, thereby to shift palm valve 95 to its second position and retract wiper pad assemblies 49*a* and 49*b*. As long as the pressure in rig standpipe 103 exceeds the set point of pressure sensor control valve 99, palm valve 95 cannot be moved to its first position and, accordingly, wiper pad assemblies 49*a* and 49*b* will remain retracted. Since the mud pumps are always actuated prior to rotation of the drill string, the wiper pads will always be retracted during rotation.

Further modifications and alternative embodiments of the apparatus of this invention will be apparent to those skilled in the art in view of this description. Accordingly, this description is to be construed as illustrative only and is for the purpose of teaching those skilled in the art the manner of carrying out the invention. It is to be understood that the form of the invention herewith shown and described is to be taken as the presently preferred embodiment. Various changes may be made in the shape, size, and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. A wiper device for stripping fluid from the external surface of tubular articles being pulled from the wellhead of a well, which comprises:

a container having bottom and side walls, said bottom wall having an opening for the passage of said tubular articles therethrough;

a carriage movably mounted in said container;

a pair of wiper pad assemblies one overlying the other and slidingly mounted for inward and outward movement with respect to each other in said carriage, each of said wiper pad assemblies including a resilient wiper pad mounted to a mounting frame, each of said mounting frames including a connection slot that is elongated in the direction perpendicular to the direction of said inward and outward movement of said wiper pad assemblies in said carriage;

and a pair of opposed actuator assemblies for moving said wiper pad assemblies inward and outward with respect to each other in said carriage, each of said actuator assemblies including a cylinder nonmovably connected to said container and a piston rod connected to one of said wiper assemblies by pin means slidingly disposed in said connection slot.

2. The wiper device as claimed in claim 1, wherein said cylinders of said actuator assemblies are connected to opposed side walls of said container.

3. The wiper device as claimed in claim 2, wherein said cylinders extend outwardly of said container.

4. The wiper device as claimed in claim 3, including tubular housing means connected to said opposed side walls of said container for housing said cylinders.

5. The wiper device as claimed in claim 1, wherein said bottom wall slopes downwardly and inwardly toward said opening.

6. The wiper device as claimed in claim 5, including rail means for movably supporting said carriage in said container.

7. The wiper device as claimed in claim 5, including means for spraying water into the interior of said container to wash fluid therefrom.

8. The wiper device as claimed in claim 1, including a cover connected to said container, said cover having an opening aligned with said bottom wall opening.

9. The wiper device as claimed in claim 8, wherein said cover includes frusto-conical guide means positioned for guiding articles into said cover opening.

10. The wiper device as claimed in claim 8, wherein said cover is hingedly connected to said container.

11. The wiper device as claimed in claim 8, wherein said cover includes a pair of doors hingedly connected to said container, each of said doors having a semi-circular cutout portion to define said cover opening.

12. The wiper device as claimed in claim 11, wherein each of said doors includes guide means positioned for deflecting articles into said opening.

13. The wiper device as claimed in claim 1, wherein said actuator assemblies are arranged to extend said wiper pad assemblies completely over said bottom opening when no tubular articles are between said wiper pads, thereby to prevent objects from falling into said wellhead.

14. The wiper device as claimed in claim 1, including pneumatic means for extending and retracting said actuators.

15. The wiper device as claimed in claim 14, wherein said pneumatic means includes:

means for sensing fluid pressure supplied to the well;

and means for retracting said actuators when said fluid pressure exceeds a preselected amount.

16. The wiper device as claimed in claim 14, wherein:

each of said actuators includes an extension port and a retraction port and said pneumatic means includes:

a retraction conduit connected to supply air to said retraction port and an extension conduit connected to supply air to said extension port;

a manually operable valve movable between a first position in which air is supplied to said retraction conduit and said extension conduit is vented, and a second position in which air is supplied to said extension conduit and said retraction conduit is vented;

and a source for supplying operating air to said manually operated valve.

17. The wiper device as claimed in claim 16, including means responsive to the pressure of fluid supplied to the well for moving said valve to said first position when said pressure exceeds a preselected amount.

18. The wiper device as claimed in claim 17, wherein said valve moving means includes:

a pressure sensor control valve operated responsive to said well pressure to move between a first position in which a control pressure is supplied to move said manual operated valve to its first position and a second position in which control pressure is vented from said manually operated valve to allow said manually operated valve to be moved to its second position;

and a source for supplying control air to said control valve.

19. A system for stripping fluid from the external surface of tubular articles being pulled from the wellhead of a well, said system being used in conjunction with a rig having a source for supplying fluid to said well, said system comprising:

a carriage mountable over said wellhead;

a pair of wiper pad assemblies slidingly mounted for inward and outward movement with respect to each other in said carriage;

actuator means for moving said wiper pad assemblies inward and outward with respect to each other in said carriage, said actuator means including an actuator having a cylinder and piston rod movable between a retracted position with respect to said cylinder and an extending position with respect to said cylinder;

pneumatic means for extending and retracting said piston rod;

means for sensing the pressure of said fluid supplied to said well;

and means for moving said wiper pads outward with respect to each other when said pressure of said fluid supplied to said well exceeds a preselected amount.

20. The wiper device as claimed in claim 19, wherein:

said cylinder includes an extension port and a retraction port and said pneumatic means includes:

a retraction conduit connected to supply air to said retraction port and an extension conduit connected to supply air to said extension port;

a manually operated valve movable between a first position in which air is supplied to said retraction conduit and said extension conduit is vented, and a second position in which air is supplied to said extension conduit and said retraction conduit is vented;

and a source for supplying operating air to said manually operated valve.

21. The system as claimed in claim 20, including means responsive to the pressure of fluid supplied to the well for moving said valve to said first position when said pressure exceeds a preselected amount.

22. The system as claimed in claim 21, wherein said valve moving means includes:

a pressure sensor control valve operated responsive to said well pressure to move between a first position in which a control pressure is supplied to move said manually operated valve to its first position and a second position in which control pressure is vented from said manually operated valve to allow said manually operated valve to be moved to its second position;

and a source for supplying control air to said control valve.

* * * * *